US006257467B1

(12) United States Patent
Chen

(10) Patent No.: US 6,257,467 B1
(45) Date of Patent: Jul. 10, 2001

(54) MOBILE MANNEQUIN

(76) Inventor: Jack Chen, No. 2, Alley 49, Lane, 149 Sec. 3 Nankang Road Taipei (TW)

( * ) Notice: Subject to any disclaimer, the term of this patent is extended or adjusted under 35 U.S.C. 154(b) by 0 days.

(21) Appl. No.: 09/429,263

(22) Filed: Oct. 29, 1999

(30) Foreign Application Priority Data

Dec. 15, 1998 (TW) ..... 98 2 39682

(51) Int. Cl.[7] ..... D06C 15/00
(52) U.S. Cl. ..... 223/66; 223/68
(58) Field of Search ..... 223/66, 68, 69, 223/84, 120; 434/396

(56) References Cited

U.S. PATENT DOCUMENTS 1,189,585 * 7/1916 Kruse ..... 223/66
1,551,250 * 8/1925 Henry ..... 223/66
1,685,358 * 9/1928 Harcourt ..... 223/66
2,468,476 * 4/1949 Wilken ..... 223/66
5,480,074 * 1/1996 Duncan et al. ..... 223/66
5,782,389 * 7/1998 Maharg ..... 223/66

OTHER PUBLICATIONS

Rhode Island Bar Journal, Apr., 1999, p. 49; "LegalDesign, inc." (Advertisement).
Photograph of Prior Art Mannequin.

* cited by examiner

*Primary Examiner*—Bibhu Mohanty

(57) ABSTRACT

A mannequin using ball joints for movably connecting a neck and extremities to a two-piece trunk section is disclosed. Each ball joint is provided with a built-in spring to allow free movement of the mannequin as desired by its user. The trunk sections are connected together by a flexible elbow to permit various positioning of the trunk section of the mannequin.

17 Claims, 3 Drawing Sheets

MOBILE MANNEQUIN

BACKGROUND OF THE INVENTION

The present invention relates to a utility model of mannequin, and more particularly to an improved structure of a mobile mannequin. Mannequins having movable joints are known in the art for a variety of purposes such as art study and sporting demonstrations. For example, known mannequins have movable arms, legs, hands and feet. One known type of mannequin includes a trunk ball joint to permit limited motion of a trunk section of the mannequin. However, known trunk ball joints limits movement of the trunk section mannequin, thereby limiting the number of possible positions for the mannequin. Accordingly, the mannequin is prevented from achieving a substantial number of desired poses or motions.

SUMMARY OF THE INVENTION

The primary objective of the present invention is to provide an improved mobile mannequin which allows free manipulation of the mannequin to achieve any desired pose and motion. Accordingly, the present invention includes a two-piece trunk section connected together by a flexible elbow. The elbow is encladded with multiple washers and folded members. Locating wires extend between the trunk sections to properly secure the washers together. The elbow allows for increased manipulation of the mannequin into various poses and motions.

Figure 1:
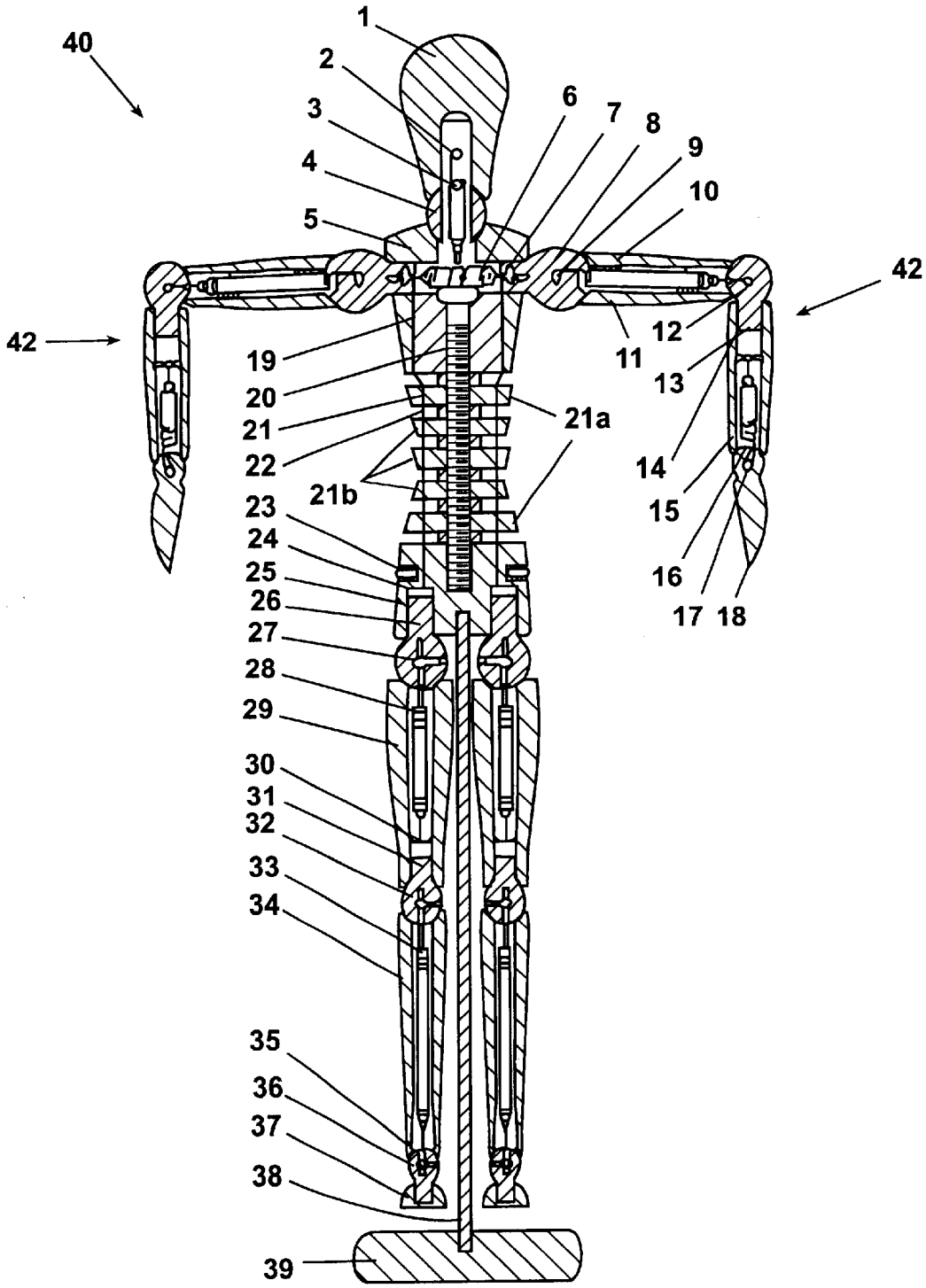
FIG. 1 is a cross-sectional view of the mannequin of the preferred embodiment of the present invention.
Figure 2:
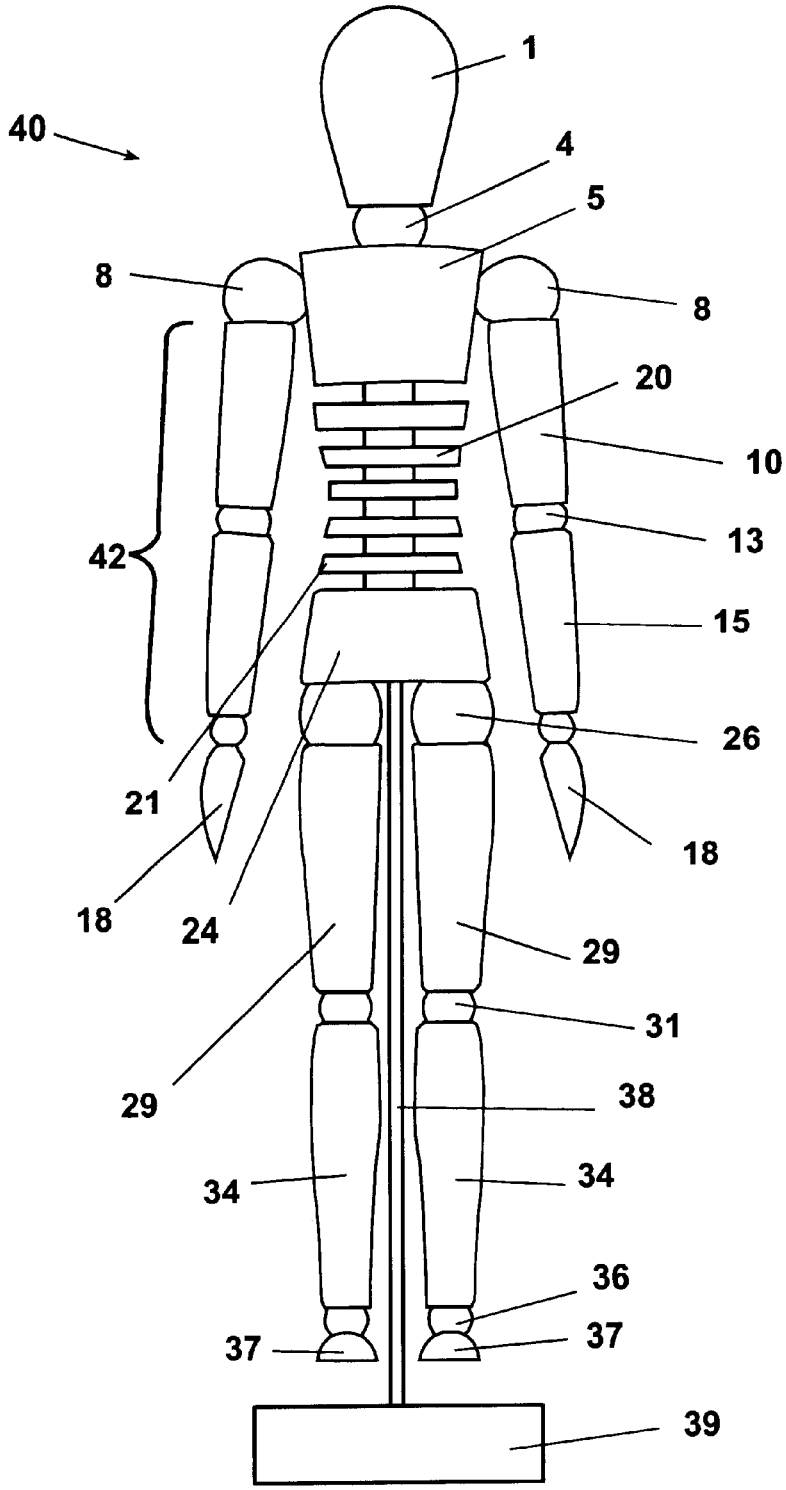
FIG. 2 is an elevational view of the mannequin of the present invention.
Figure 3:
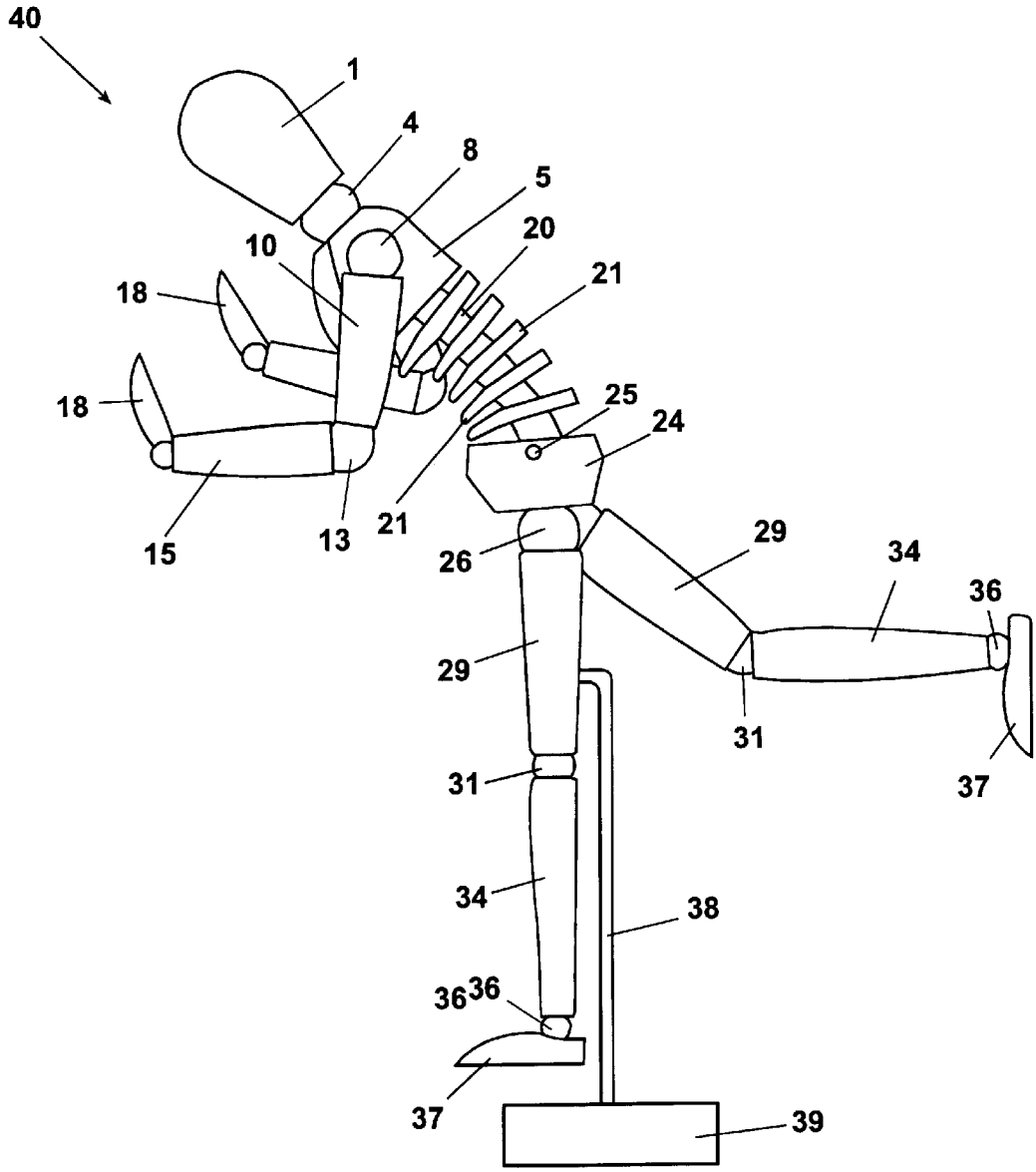
FIG. 3 is a side view of the mannequin in a pose in accordance with the preferred embodiment of the present invention.

DETAILED DESCRIPTION OF THE INVENTION:

Referring to FIGS. 1–3, an improved mobile mannequin 40, in accordance with the present invention, is shown. Mannequin 40 includes an upper body portion and a lower body portion. Upper body portion has a head 1, an upper trunk 5, arms 42, and palms 18. Head 1 and upper trunk 5 are connected together with a neck ball joint 4. A head screw 2 is provided in the head 1 and connected to one end of a central spring 3. A shoulder ball joint 8 is positioned within arm holes formed at both ends of the upper trunk 5. A shoulder spring 6 is provided in the upper trunk 5 and the other end of the central spring 3 is connected to the shoulder spring 6. Both ends of the shoulder spring 6 are fixed at the shoulder ball joint 8 with a screw 7.

Arms 42 further include upper and lower arm portions 10 and 15, respectively. Both upper and lower arms 10 and 15, respectively, are connected together by an elbow ball joint 13. An upper arm spring 11 is built in upper arm 10 with one end of upper arm spring 11 fixed onto the shoulder ball joint 8 with a screw 9. The other end of upper arm spring 11 is fixed onto the elbow ball joint 13 with a screw 12. A lower arm nail 14 is fixed on the lower arm 15 with one end of a lower arm spring 16 is being fixed on the lower arm nail 14. The other end of the lower arm spring 16 is fixed to palm 18 with a screw 17.

Lower body portion includes a lower trunk 24, thighs 29, legs 34 and feet 37. A flexible elbow 20 is provided at the center of the upper trunk 5 whereby the elbow 20 is connected to and extending downwardly from upper trunk 5, to connect upper trunk 5 to lower trunk 24. The elbow 20 is encladded with multiple washers 21 and folded members 22 with the lower end of the elbow 20 inserted into and fixed in the lower trunk 24. The washers 21 are spaced apart along elbow 20, with folded members 22 positioned between adjacent washers 21. The washers 21 have varying diameters. For example, the outermost washers 21*a* have larger diameters as compared to the inner washers 21*b*, providing an hourglass shape. Further, the forward portions of the washers 21 may be beveled, as best seen in FIG. 3, to permit a greater degree of bending. Locating wires 19 penetrate between the upper trunk 5 and the lower trunk 24, equally spaced from elbow 20 and extending through each washer 21.

A nut 23 is caulked into the lower trunk 24 to connect to a threaded post 38. Threaded post 38 is connected with threads to a base plate 39 for supporting the mannequin.

The lower trunk 24 also connects to each thigh 29 via a thigh hinge ball joint 26. Thigh hinge ball joint 26 is held in position to the lower trunk 24 through a side nail 25 of the lower trunk 24. A screw 27 is provided on the thigh ball joint 26, which is fixed with a thigh nail 30. One end of a thigh spring 28 is fixed onto the screw 27 while the other end of the thigh spring 28 is fixed to the screw of the thigh nail 30. The thigh 29 connects to a leg 34 with a knee ball joint 31 by a screw 32.

The leg 34 and the foot 37 are connected together with an ankle ball joint 36 by a screw 35. One end of a leg spring 33 is fixed to the screw 32 of the knee ball 31. The other end of the leg spring 33 is fixed to the screw 35 at the ankle ball joint 36.

The present invention of the mannequin allows motions of bowing, supine and prostrate positions. For example, FIG. 3 shows the mannequin in a bent over position. Further, each and all parts of the mannequin body are capable of free movement to achieve various poses and motion as desired for the general public and students of arts. The present invention can also be used for demonstration purposes for swimming gymnastics and other sports, or simply as an artistic object for appreciation.

I claim:

1. A mobile mannequin, comprising:

a trunk section having upper and lower trunks;

a pair of arms movably connected to said upper trunk;

a head movably connected to said upper trunk; and a pair of leg members movably connected to said lower trunk;

wherein said upper and lower trunk are connected together by a flexible elbow having a diameter substantially less than the diameters of said upper and lower trunks, such that said upper and lower trunks are movable with respect to one another to permit positioning of said mannequin;

wherein said flexible elbow is encladded with a plurality of washers positioned between said upper and lower trunks.

2. The mannequin of claim 1, wherein each of said arms are movably connected to said upper trunk by a shoulder ball joint, and further including a central spring positioned perpendicular to a shoulder spring, wherein said head is fixedly connected to a first end of a central spring and a second end of said central spring is fixedly connected to a section of said shoulder spring, and each end of said shoulder spring being fixedly connected to one of said shoulder ball joints.

3. The mannequin of claim 1, wherein said flexible elbow is further encladded with a plurality of folded members, said folded members being positioned between adjacent washers.

4. The mannequin of claim 1, wherein said washers are equally spaced apart from one another.

5. The mannequin of claim 1, wherein said washers have varying diameters, said washers positioned adjacent to said upper and lower trunks having a greater diameter than said diameters of said remaining washers.

6. The mannequin of claim 1, wherein a portion of each of said washer is beveled in a downwardly sloping manner, said portions being positioned in alignment to permit bending of said trunk section.

7. The mannequin of claim 1, further including locating wires extending between said upper and lower trunks, said locating wires extending through said washers.

8. The mannequin of claim 1, wherein said head is movably connected to said upper trunk by a neck ball joint.

9. The mannequin of claim 2, wherein said arms include upper and lower arm portions, a first end of each of said upper arm portion being movably connected to said upper trunk by said shoulder joint, a second end of each of said upper arm portion being movably connected to a first end of said lower arm portion by an elbow ball joint, a second end of each of said lower arm portion movably connected to a palm.

10. The mannequin of claim 9, further including upper and lower arm springs, wherein said upper arm spring has a first end fixedly connected to said shoulder ball joint and a second end fixedly connected to said elbow ball joint, and wherein said lower arm spring has a first end is fixedly connected to a section of said lower arm portion and a second end fixedly connected to said palm.

11. The mannequin of claim 1, wherein each of said leg members include a thigh, leg and foot, each of said thighs being movably connected to said lower trunk by a thigh ball joint, each of said legs being movably connected to one of said thighs by a knee ball joint, and each of said feet being movably connected to one of said legs by an ankle ball joint.

12. The mannequin of claim 11, wherein each leg member further includes a thigh spring and a leg spring, wherein a first end of each of said thigh springs is fixedly connected to one of said thigh ball joints and a second end of each of said thigh springs is fixedly connected to a section of said thigh, wherein a first end of each of said leg springs is fixedly connected to one of said knee ball joints and a second end of each of said leg springs is fixedly connected to one of said ankle ball joints.

13. A mobile mannequin, comprising:

a trunk section having upper and lower trunks, spaced apart and connected together by a flexible elbow having a diameter substantially less than the diameters of said upper and lower trunks such that said upper and lower trunks are movable with respect to one another to permit positioning of said mannequin;

said elbow being encladded with a plurality of washers positioned between said upper and lower trunks, wherein said washers have varying diameters such that said washers positioned adjacent to said upper and lower trunks have a greater diameter than said diameters of said remaining washers;

a pair of arms movably connected to said upper trunk with shoulder ball joints;

a head movably connected to said upper trunk by a neck ball joint; and a pair of leg members connected to said lower trunk with thigh ball joints.

14. The mobile mannequin of claim 13, wherein said flexible elbow is further encladded with a plurality of folded members, said folded members being arranged in an alternating manner with said washers such that at least one folded member is positioned between adjacent washers.

15. The mobile mannequin of claim 13, wherein a portion of each of said washer is beveled in a downwardly sloping manner, with said portions being positioned in alignment to permit bending of said trunk section.

16. The mobile mannequin of claim 13, further including locating wires extending between said upper and lower trunks, said locating wires being positioned on opposite sides of said elbow and extending through said washers.

17. A mobile mannequin, comprising:

a trunk section having upper and lower trunks, spaced apart and connected together by a flexible elbow having a diameter substantially less than the diameters of said upper and lower trunks such that said upper and lower trunks are movable with respect to one another to permit positioning of said mannequin;

said elbow being encladded with a plurality of washers and folded members positioned between said upper and lower trunks;

said washers having varying diameters such that said washers positioned adjacent to said upper and lower trunks have a greater diameter than said diameters of said remaining washers and wherein a portion of each of said washer is beveled in a downwardly sloping manner, with said portions being positioned in alignment to permit bending of said trunk section;

said folded members being arranged in an alternating manner with said washers such that at least one folded member is positioned between adjacent washers;

locating wires extending between said upper and lower trunks, said locating wires being positioned on opposite sides of said elbow and extending through said washers;

a pair of arms movably connected to said upper trunk with shoulder ball joints;

a head movably connected to said upper trunk by a neck ball joint; and a pair of leg members connected to said lower trunk with thigh ball joints.

* * * * *